US006132122A

United States Patent [19]

Robinson et al.

[11] Patent Number: 6,132,122

[45] Date of Patent: Oct. 17, 2000

[54] LOW PROFILE ARCHITECTURE FOR INTERNET APPLIANCE PRINTING

[75] Inventors: Andrew R. Robinson; Kerry N. McKay; Kirkpatrick W. Norton, all of San Diego, Calif.

[73] Assignee: Hewlett-Packard Company, Palo Alto, Calif.

[21] Appl. No.: 09/382,706

[22] Filed: Aug. 23, 1999

[51] Int. Cl.[7] ..... B41J 11/58

[52] U.S. Cl. ..... 400/624; 400/625; 400/691

[58] Field of Search ..... 400/624, 625, 400/626, 628, 629, 691, 692, 693

[56] References Cited

U.S. PATENT DOCUMENTS

| | | | |
|---|---|---|---|
| 4,089,402 | 5/1978 | Hyland et al. | 400/625 |
| 4,698,650 | 10/1987 | Watanabe et al. | 346/134 |
| 4,847,632 | 7/1989 | Norris | 346/107 |
| 5,017,033 | 5/1991 | Hermann et al. | 400/693 |
| 5,105,281 | 4/1992 | Kusaka | 358/302 |
| 5,111,216 | 5/1992 | Richardson et al. | 346/76 |
| 5,152,622 | 10/1992 | Rasmussen et al. | 400/624 X |
| 5,372,512 | 12/1994 | Wilson et al. | 439/67 |
| 5,620,269 | 4/1997 | Gustafson | 400/624 |
| 5,746,526 | 5/1998 | Hirose | 400/619 |
| 5,746,528 | 5/1998 | Mayer et al. | 400/625 |

OTHER PUBLICATIONS

HP DeskJet 1200 C Printer Architecture, Hewlett–Packard Journal, Feb. 1994, pp. 55–66.

Media Path for a Small, Low–Cost, Color Thermal Inkjet Printer, Hewlett–Packard Journal, Feb. 1994, pp. 72–78.

*Primary Examiner*—John S. Hilten
*Assistant Examiner*—Minh Chau

[57] ABSTRACT

A printer architecture provides for significant reduction in overall printer height, allowing front panel of the printer to be used for print cartridge, paper jam, paper load, and print retrieval access. The input paper tray is placed above the output paper tray, behind the scanning print cartridges. The print bar is located adjacent the front panel, allowing the user to easily access paper jams and the print cartridges. This placement of the print bar also facilitates stacking the printer in a racked system or in a consumer entertainment system to perform these necessary functions without removal of the printer from the stack. The output tray is mounted for sliding motion, so that the user can access the printed output upon completion without having to leave an extended paper output during printing. The printing mechanism is located on a slide drawer to allow the user access to load the input tray.

24 Claims, 6 Drawing Sheets

LOW PROFILE ARCHITECTURE FOR INTERNET APPLIANCE PRINTING

TECHNICAL FIELD OF THE INVENTION

This invention relates to inkjet printers, and more particularly to low profile printer architectures useful in stacked equipment bays.

BACKGROUND OF THE INVENTION

Inkjet printers have become ubiquitous in office and home environments. Some common applications are for desktop, computer aided design (CAD) and photographic printing. Known inkjet printer architectures are not designed for the home entertainment living space, where the emphasis is on low overall height and complete front panel access to all features of the information device. Inkjet printers have typically employed a top access cover, requiring that space be available immediately above the printer to allow the printer cover to swing up and open. This top cover prevents stacking of components on top of the printer.

Access to the printing system of the printer is needed for several functions. In traditional inkjet printer architectures, paper jam access is provided through lifting of the top cover in addition to the output and input trays. It is also necessary to access the inkjet cartridges. Space is typically needed to be available above the printer to allow an access lid to be swung open.

It would be an advantage to provide a printer with low profile and with front access to the printer functions.

SUMMARY OF THE INVENTION

A printer architecture is described which provides for significant reduction in overall printer height. The design allows the front panel of the printer to be used for print cartridge, paper jam, paper load, and print retrieval access. The input paper tray is placed above the output paper tray, a fundamental departure from previous printer designs. With this orientation, the input tray can also be placed behind the scanning print cartridges.

According to another aspect of the invention, the scanning print bar is located forward with respect to the user for easier access and interaction. Traditionally, the print bar is placed above and rearward of the input and output trays. Placement of the bar in this forward position allows the user to easily access paper jams and print cartridges. Placement of the print bar also facilitates stacking the printer in a racked system or consumer entertainment system. This architecture therefore allows a user to perform these necessary functions without removal of the printer from the stack.

In accordance with another aspect of the invention, the output tray is mounted for sliding motion, so that the user can access the printed output upon completion without having an extended output tray protruding from the printer housing during printing to catch the print output. Further, the printing mechanism is located on a slide drawer to allow the user access to load the input tray.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
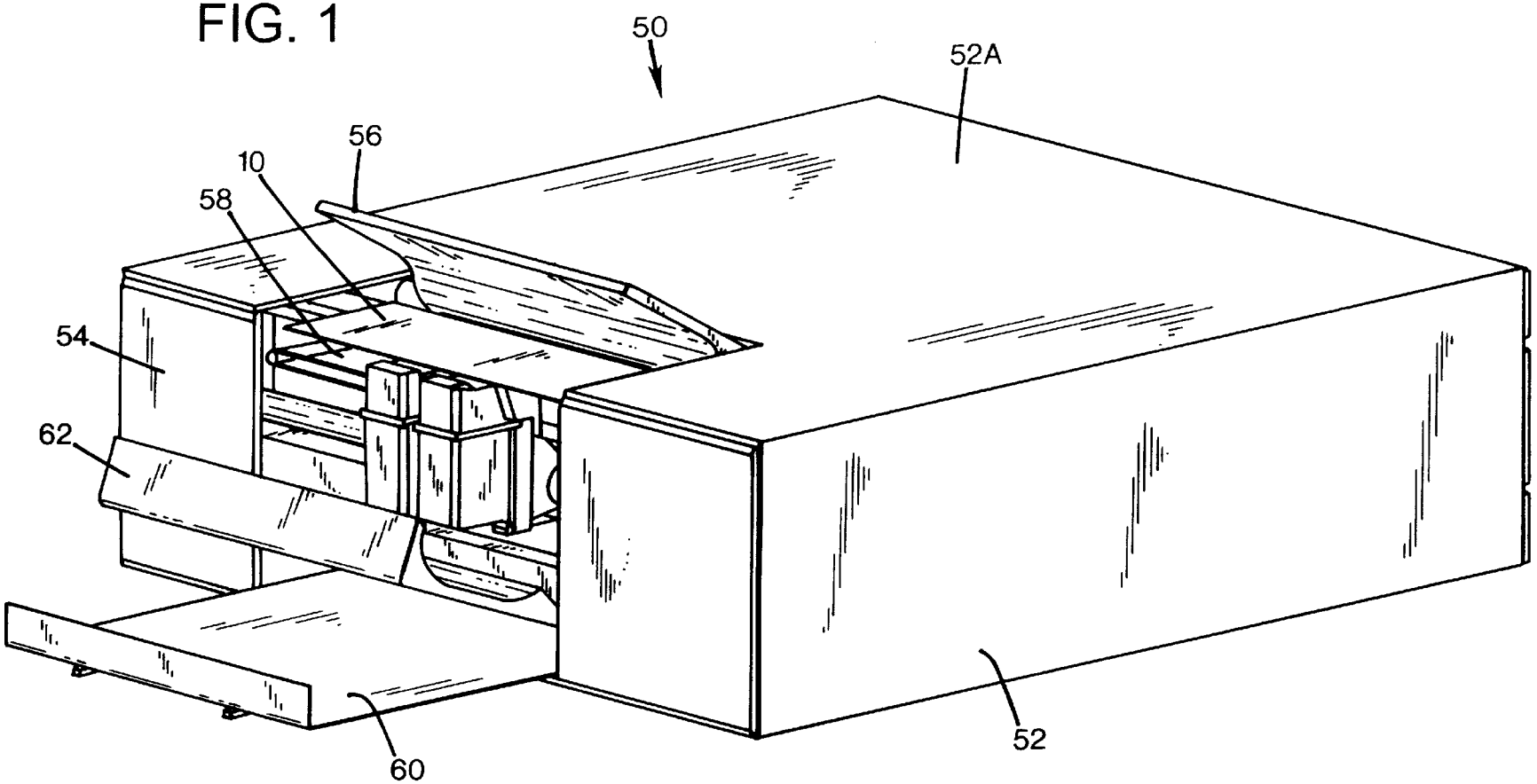
FIG. 1 is an isometric view of a low profile printer embodying the invention.

An exemplary embodiment of a low profile inkjet printer 50 in accordance with the invention is shown in the isometric view of FIG. 1. The printer includes a rectangular housing structure 52 which is open at the front of the printer. The housing structure 52 envelopes the print bar with its printing mechanism and the input and output trays, but has a front access opening which allows the printing mechanism and trays, with a front cover 54 to be pulled out on slides from the front of the printer. A top hinged cover 56 is provided in the top surface 52A of the housing structure to allow user access to the input media or paper tray 58. Also available to the user from the front of the printer is the output tray 60, which is slidable out from the front to the position shown in FIG. 1 for retrieving the printer output media.

The trays 58 and 60 each have a capacity of 50 sheets in an exemplary embodiment to minimize the height of the printer, but trays of lesser or greater capacity are within the scope of the invention.

To permit access to the printer bar and inkjet pens, a paper guide 62 rotates on a hinge from an operating position, for guiding paper from the input tray 58 to the print zone, to a service position shown in FIG. 1. With the paper guide in the service position, the pens can be accessed, and paper jams can be addressed.

Figure 2:
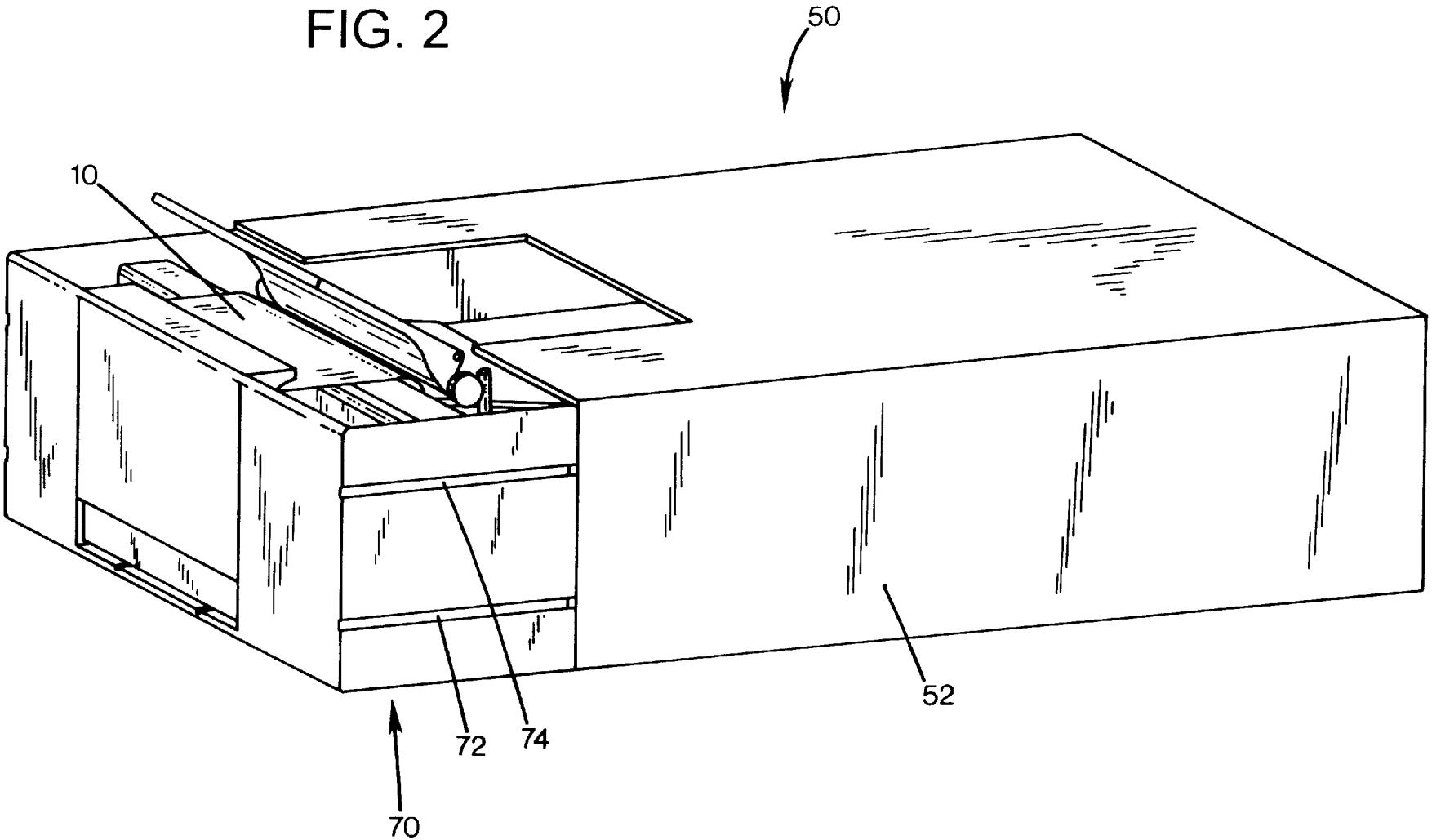
FIG. 2 is an isometric view of the printer of FIG. 1, with the print module pulled out on its slides.

FIG. 2 is an isometric view illustrating another aspect of the invention, the mounting of the print module, indicated generally as 70 in FIG. 2, on slide rails 74, 76 for sliding movement relative to the housing 52. This sliding movement is to permit the print module to be slid forward, as indicated in FIG. 2, to provide access to the input tray 58. The paper guide 62 is shown in the operating position in FIG. 2.

Figure 3:
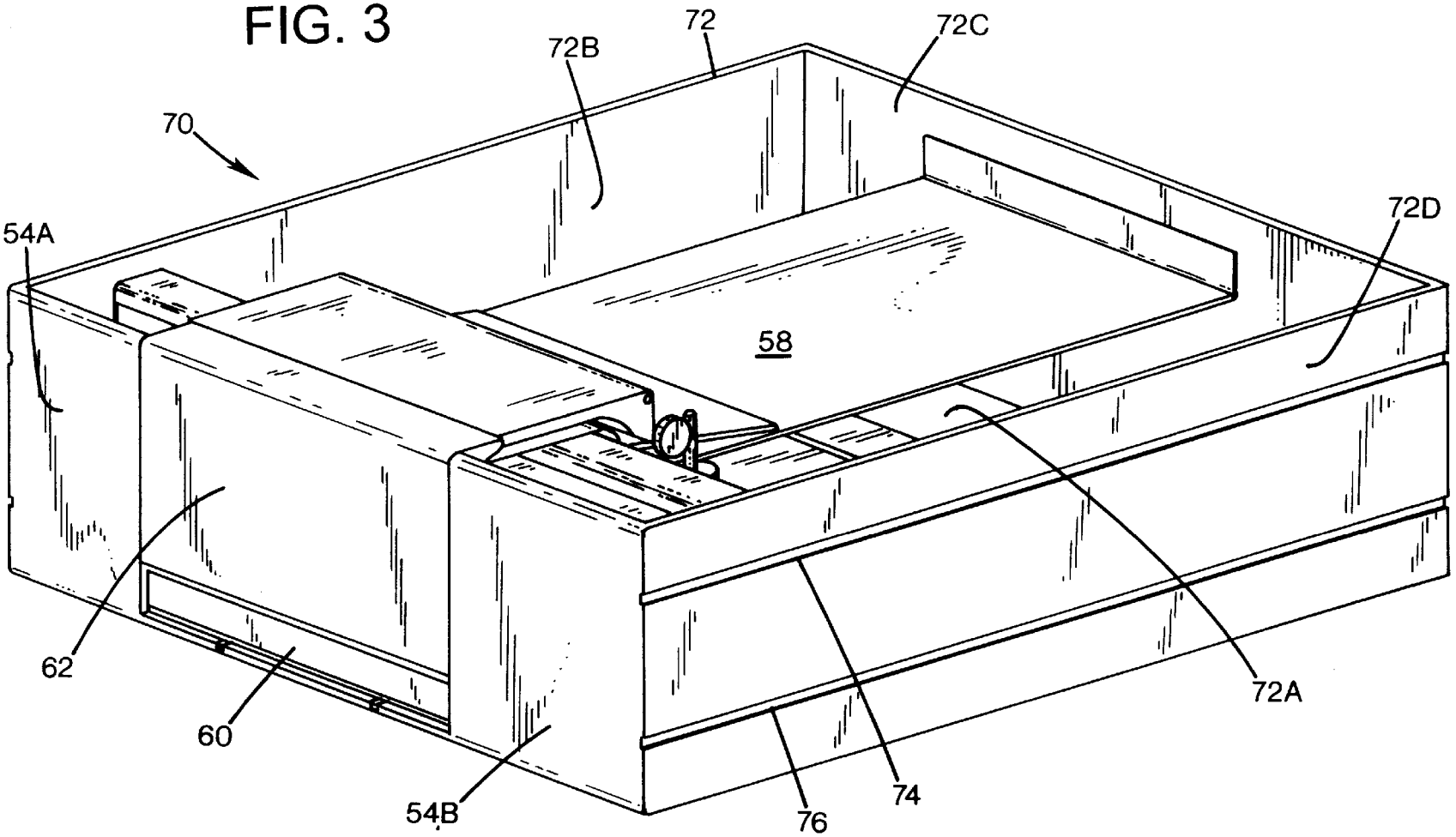
FIG. 3 is an isometric view of the printer of FIG. 1 with the external cover removed.

The print module 70 is shown in further detail in FIG. 3, in which the outer housing structure 52 is omitted for clarity. The module 70 includes a frame support structure 72 in the form of an open drawer. The structure 72 is fabricated of a rigid material such as sheet metal or a plastic material. The structure 72 includes side walls 72A, 72B, rear wall 72C and a bottom wall 72D. The front of the structure 72 has attached thereto front cover portions 54A, 54B. The input tray 58 is supported by the frame structure 72. Each side wall 72A, 72B has slide rails 74, 76 attached to or formed thereon.

Figure 4:
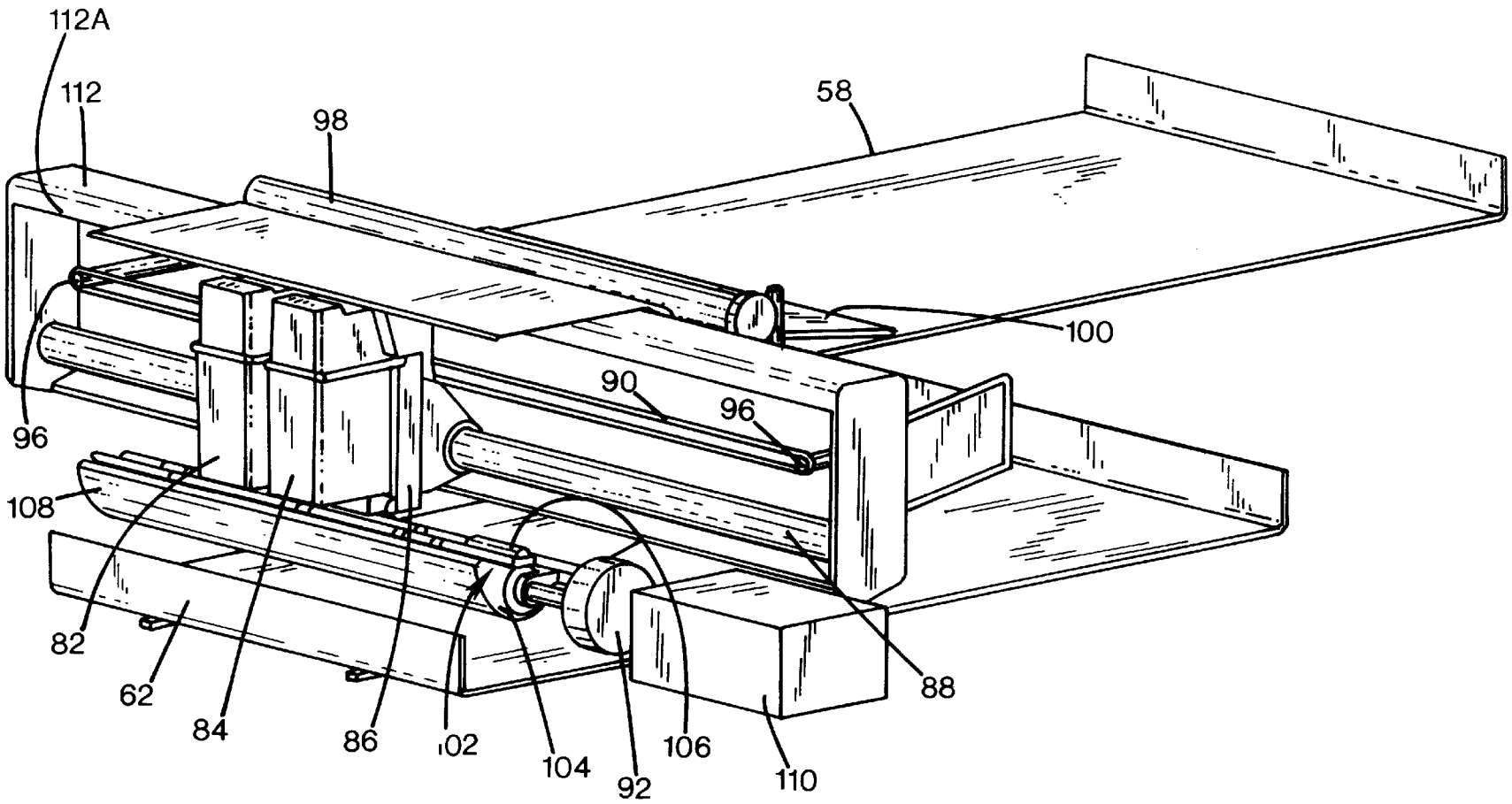
FIG. 4 is an isometric view illustrating the print module of the printer.
Figure 5:
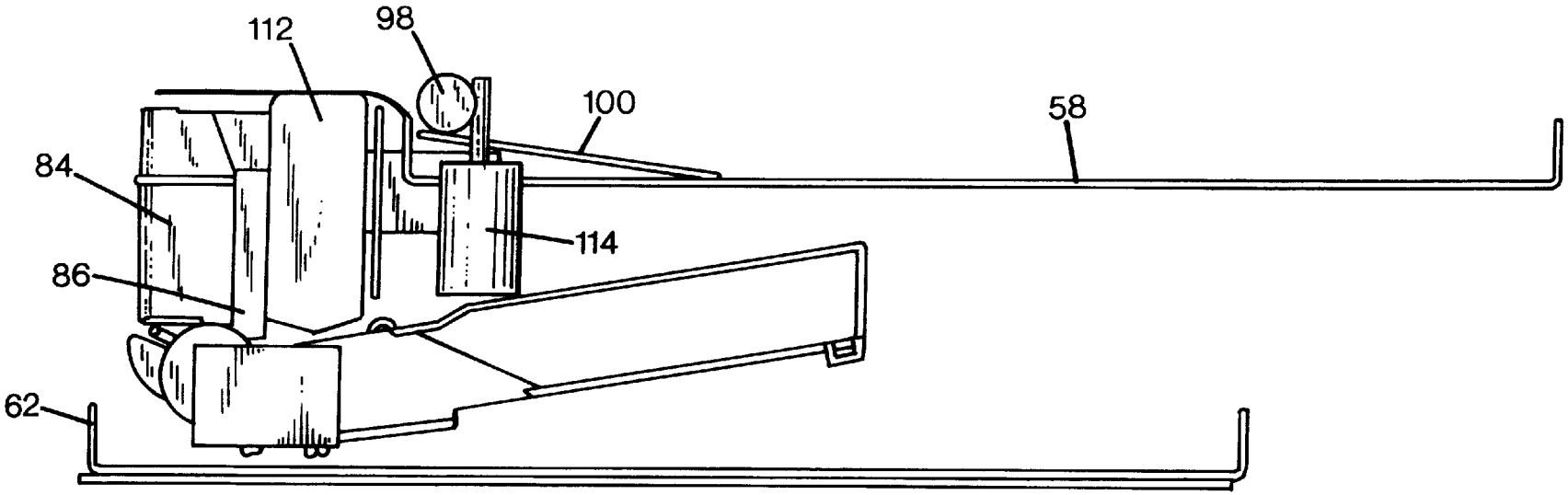
FIG. 5 is a side view of the print module of the printer.

The print bar comprising the print module 70 is shown in the simplified isometric view of FIG. 4 and the side view of FIG. 5. In this exemplary embodiment, two inkjet print cartridges 82, 84 are supported for scanning movement on a print carriage 86. The cartridges are replaceable items, which are held in removable known fashion in the carriage, where electrical connections are made to the cartridges to drive the printheads during printing operations. Typically, each printhead has a TAB circuit mounted on an external surface, which contacts a corresponding carriage TAB circuit mounted to the carriage. The carriage TAB is electrically connected by a service cable, e.g. a ribbon cable, to the printer controller.

The carriage 86 is mounted for movement along a slider rod 88. A print bar housing 112 provides structural support for the rod 88. The housing is preferably fabricated of a rigid plastic material. A carriage drive system 204 (FIG. 6) includes a drive belt 90 and a drive motor coupled to the belt by a gear train or other well known coupling mechanism. The drive motor can also drive the drive roller 104, or a separate carriage drive motor can be used. The belt 90 is mounted on pulleys 96, and is secured to the carriage so that motion of the belt also moves the carriage along the slider rod. The carriage is also guided and supported by a guide surface 112A defined by the print bar housing 112. An encoder with an encoder strip will typically be used to provide position feedback to the printer controller.

A pick roller 98 is provided to pick the top sheet 10 of print media from the input tray 58. The pick roller is driven by a drive mechanism, including a pick motor 114 and worm gear 116, although a drive through the motor 92 can be employed in an exemplary alternate embodiment. A pressure plate 100 is activated with the pick roller to exert pressure on the adjacent portion of the media stack next to the pick roller. Pressure plates, per se, are known in the art.

Also omitted for clarity from FIGS. 4 and 5 is the hinged paper guide 62, which guides the sheet 10 picked from the input tray 58, driven by the pick roller 98, to a lower fixed paper guide 108. The fixed guide 108 presents a curved surface to the sheet, guiding the leading edge of the picked sheet into the nip 102 between the drive roller 104 and pinch roller 106. The drive roller 104 is driven by the motor 92 to advance the sheet 10 past the print zone under the printheads comprising the inkjet cartridges. While the printing is underway on a sheet, the wet stacking wings are disposed together, to support the sheet being printed upon from dropping onto the previously printed sheet disposed in the output tray. Upon completion of the printing on the sheet, the wings fold outwardly, permitting the sheet to drop into the output tray.

Structure 110 indicates generally the service station, used for typical capping, wiping and spitting services for the cartridge printheads.

Figure 6:
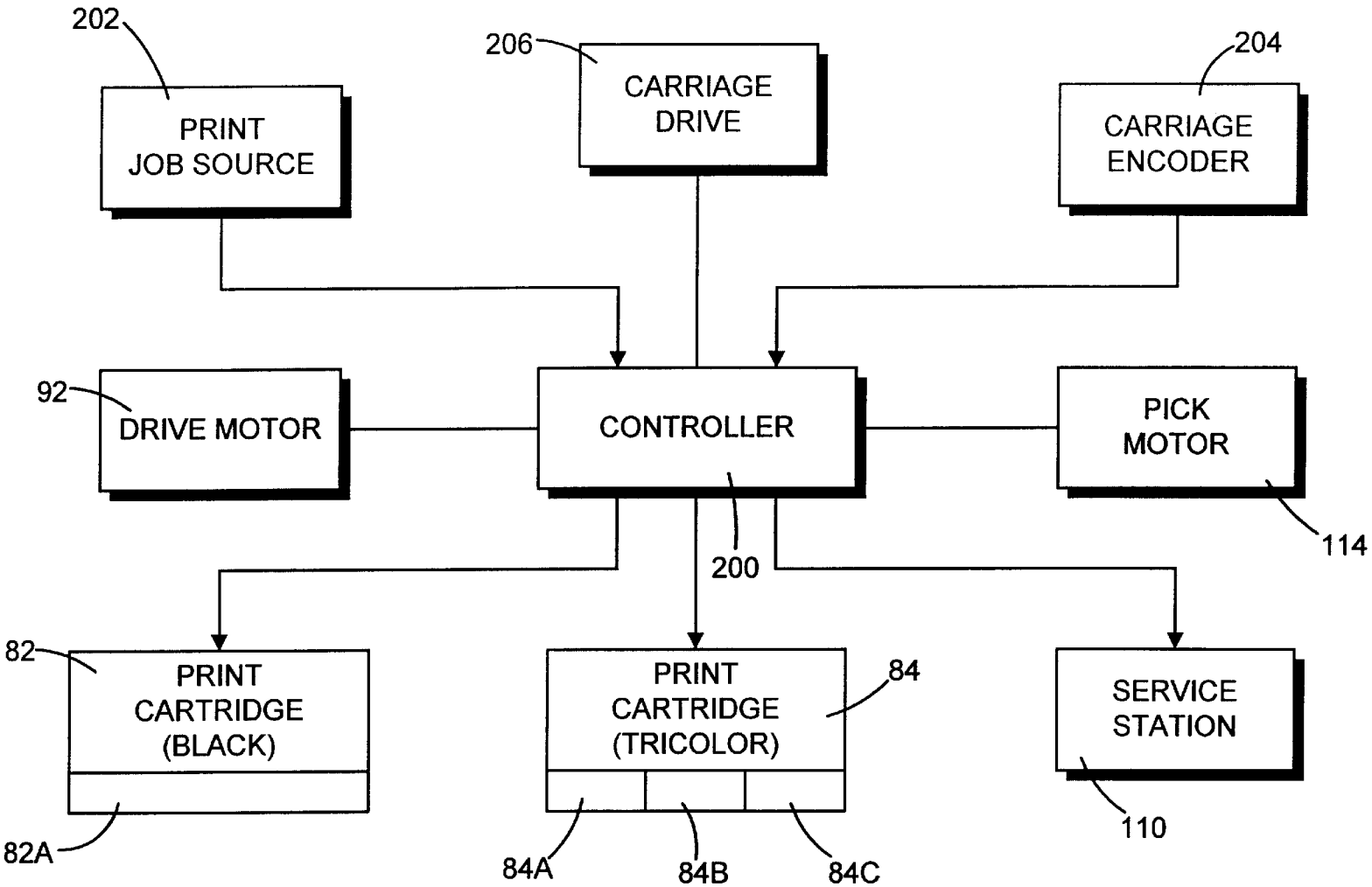
FIG. 6 is a simplified schematic block diagram of the control elements for the printer.

FIG. 6 is a schematic block diagram of the control system for the printer. A controller 200 such as a microcomputer receives print job commands and data from a print job source 202, which can be a personal computer, digital camera or other known source of print jobs. The controller acts on the received commands to activate the pick motor 114 to pick a sheet from the input tray, advance the sheet to the nip between the drive roller and pinch roller, and activate the drive motor to advance the sheet to the print zone. The carriage drive 206 is driven by the controller to position the carriage for commencement of a print job, and to scan the carriage along the slider rod. As this is done firing pulses are sent to the printheads comprising the print cartridges 82, 84. In this exemplary embodiment, the cartridge 82 is a black cartridge with a nozzle array 82A, and cartridge 84 is a tricolor cartridge with cyan, magenta and yellow ink reservoirs and corresponding nozzle arrays 84A, 84B, 84C. The cartridges can be commercially available cartridges, such as the HP 51626A and HP 51625A cartridges. The controller receives encoder signals from the carriage encoder 204 to provide position data for the carriage. The controller is programmed to advance incrementally the sheet 10 to position the sheet for successive swaths, and to eject the completed sheet into the output tray.

The controller 200 can be mounted in various locations within the housing structure 52. One exemplary location is to the back wall 72C of the drawer structure 72 below the input tray 58. The controller is connected to the carriage and printhead using a traveling cable. The controller is also connected to a power supply (not shown) affixed to the housing structure 52 in a fixed location by another traveling cable passed through the back wall 72C which accommodates sliding movement of the drawer 72 relative to the housing structure 52. Of course, many other techniques could be employed to mount the controller and connect it to the elements shown in FIG. 6.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printer with front access to printer functions, comprising:

an input tray for holding sheets of input print media;

an output tray for holding sheets of output print media;

a media path through which sheets of input print media are passed for printing operations, the media path including a generally U-shaped path portion running between the input tray and the output tray;

a printing apparatus disposed on the media path between the input tray and the output tray for printing images onto a sheet of print media, said printing apparatus including a scanning carriage supporting one or more print cartridges for scanning movement along a scan axis;

a housing structure defining a front panel access opening, the scan axis extending generally parallel to and adjacent the access opening; and wherein during printing operations, the input tray and the output tray are disposed within the housing structure such that the output tray is disposed below the input tray.

2. The printer of claim 1, wherein the media path is at least partially defined by a media guide, said guide mounted for movement between an operational position, wherein said guide at least partially defines the U-shaped path portion, and a service position allowing access to the printer apparatus through said front panel access opening.

3. The printer of claim 2 wherein the hinged media guide is a front cover of the printer at the access opening when in the operational position, and wherein the front cover can be moved from the operational position to the service position without requiring clearance space above the printer to accommodate the front cover movement.

4. The printer of claim 1, wherein the printing apparatus includes a print bar housing structure, and wherein the input tray is located behind the print bar housing structure.

5. The printer of claim 4, wherein the input tray is located at an elevation at or below a highest elevation of the print bar housing structure to facilitate a low printer profile.

6. The printer of claim 1 further comprising a frame support structure supporting the input tray, the output tray and the printing apparatus, the frame support structure adapted for sliding movement relative to the housing structure from a closed position wherein the frame support structure, the input tray, the output tray and the printing apparatus are substantially within the housing structure, and an open position wherein the input tray, the output tray and the printing apparatus are moved outwardly with respect to said housing structure to be accessible for servicing operations.

7. The printer of claim 6 further comprising slide apparatus supporting the frame support structure for said sliding movement.

8. The printer of claim 6 wherein the housing structure defines an open volume within the housing structure, and the frame support structure is a drawer adapted to fit within said open volume in said closed position.

9. The printer of claim 8 wherein the open volume is a generally rectilinear open volume, and the drawer has a generally rectilinear configuration.

10. The printer of claim 1 wherein the output tray is adapted for sliding movement from a first position to receive the sheets of print media during printing operations to a second exposed position to allow the user to access the print media in the output tray.

11. The printer of claim 1 wherein the printing apparatus includes an inkjet print cartridge comprising a nozzle array.

12. The printer of claim 11 wherein the nozzle array faces in a downward direction to emit droplets of ink in a generally vertical direction to a print zone during printing operations.

13. The printer of claim 12 further including a fixed media guide presenting a curved surface defining a portion of said media path.

14. The printer of claim 12 wherein the input tray is parallel to the output tray.

15. The printer of claim 14 wherein the input tray and the output tray are disposed in generally horizontal orientations during printing operations.

16. A low profile printer with front access to printer functions, comprising:

a printer housing structure having a generally horizontal top surface and a generally vertical front panel;

an input tray disposed within the housing structure for holding sheets of input print media;

an output tray disposed within the printer housing structure and below the input tray during printing operations for receiving and holding sheets of output print media;

a media path through which sheets of input print media are passed for printing operations, the media path running between the input tray and the output tray and including a curved path portion to allow sheets to change direction between said input tray and said output tray;

a printing apparatus disposed on the media path between the input tray and the output tray for printing images onto a sheet of print media, said printing apparatus including a scanning carriage supporting one or more print cartridges for scanning movement along a scan axis, the scan axis disposed generally parallel to the front panel;

wherein the output tray is disposed below the input tray and the printing apparatus, and the input tray is disposed behind the printing apparatus and does not extend above the printing apparatus to facilitate a low printer profile.

17. The printer of claim 16, wherein the media path is at least partially defined by a hinged media guide, said guide mounted for hinged movement between an operational position, wherein said guide includes a curved guide surface at least partially defining the curved path portion, and a service position in which the curved guide surface is positioned away from the printer apparatus allowing access to the printer apparatus through said front panel.

18. The printer of claim 17 wherein the hinged media guide provides at least a portion of the front panel when in the operational position.

19. The printer of claim 17 further comprising a housing structure defining said front access opening, a frame support structure supporting the input tray, the output tray and the printing apparatus, the frame support structure adapted for sliding movement relative to the housing structure from a closed position wherein the frame support structure, the input tray, the output tray and the printing apparatus are substantially within the housing structure, and an open position wherein the input tray, the output tray and the printing apparatus are moved outwardly with respect to said housing structure to be accessible for servicing operations.

20. The printer of claim 19 wherein the housing structure defines an open volume within the housing structure, and the frame support structure is a drawer adapted to fit within said open volume in said closed position.

21. The printer of claim 16 wherein the output tray is adapted for sliding movement from a first position to receive the sheets of print media during printing operations to a second exposed position relative to the front panel to allow the user to access the print media in the output tray from a position in front of the printer.

22. The printer of claim 16 wherein the input tray is parallel to the output tray.

23. A low profile printer architecture with front access to printer functions, characterized by:

a printer housing structure having a generally horizontal top surface and a generally vertical front panel;

an input tray disposed within the housing structure for holding sheets of input print media;

an output tray disposed below the input tray and within the printer housing structure during printing operations for receiving and holding sheets of output print media;

a media path through which sheets of input print media are passed for printing operations, the media path running between the input tray and the output tray and including a curved path portion to allow sheets to change direction between said input tray and said output tray;

a printing apparatus disposed on the media path between the input tray and the output tray for printing images onto a sheet of print media, said printing apparatus including a scanning carriage supporting one or more print cartridges for scanning movement along a scan axis, the scan axis disposed generally parallel to the front panel;

wherein the output tray is disposed below the input tray and the printing apparatus, the input tray is disposed behind the printing apparatus and does not extend above the printing apparatus to facilitate a low printer profile;

a displaceable front panel cover which is movable from a closed position to an open position to provide user access to the printing apparatus from the front panel of the printer.

24. The printer architecture of claim 23 wherein the front panel cover includes a curved guide surface for at least partially defining said curved path portion when said cover is in said closed position.

* * * * *